United States Patent [19]

Diegelman

[11] Patent Number: 4,461,098

[45] Date of Patent: Jul. 24, 1984

[54] GAITOR WITH IMPROVED MOISTURE PENETRATION PROTECTION

[76] Inventor: David Diegelman, P.O. Box 1129, Tahoe City, Calif. 95730

[21] Appl. No.: 458,572

[22] Filed: Jan. 17, 1983

[51] Int. Cl.[3] ..... A41D 17/00

[52] U.S. Cl. ..... 36/2 R; 36/7.1 R; 2/61

[58] Field of Search ..... 36/1.5, 2 R, 45, 7.1 R, 36/7.1 A, 7.2, 8.1; 2/255, 61

[56] References Cited

U.S. PATENT DOCUMENTS

| | | | |
|---|---|---|---|
| 1,335,287 | 3/1920 | Lundin et al. | 36/8.1 |
| 2,230,291 | 2/1941 | Evans | 36/1.5 X |
| 3,875,687 | 5/1975 | Henderson | 36/7.1 R |
| 4,067,126 | 1/1978 | Bergeron et al. | 36/45 X |

FOREIGN PATENT DOCUMENTS

| | | | |
|---|---|---|---|
| 2236435 | 2/1975 | France | 36/7.1 |
| 2342676 | 8/1977 | France | 2 R/ |

*Primary Examiner*—Werner H. Schroeder

*Assistant Examiner*—Tracy Graveline

*Attorney, Agent, or Firm*—Willis E. Higgins

[57] ABSTRACT

A gaitor (10) has an upper fabric portion (12) configured to be wrapped around a leg of a wearer. The fabric portion (12) has a zipper (40) for fastening the portion (12) around the leg. The fabric portion (12) has a lower edge (26). A rubber gasket (14) configured to conform closely to a shoe (16) worn by the wearer has an upper rim (24). The gasket (14) is fastened by means of a seam (28) around the lower edge (26) of the fabric portion (12). The lower edge (26) of the fabric portion (12) is folded up to lie against the upper rim (24) of the gasket (14). The seam (28) fastens the folded up lower edge (26) against the upper rim (24) of the gasket (14). A structural tape (60) formed from a nylon sheet die cut into a strip with alternating wide and narrower portions (64 and 66) is fastened along seam (28) at toe (54) of the gaitor to prevent folding of the rubber gasket (14), which is otherwise prone to occur at the toe (54), resulting in tearing of the seam (28) when stressed.

9 Claims, 3 Drawing Figures

GAITOR WITH IMPROVED MOISTURE PENETRATION PROTECTION

BACKGROUND OF THE INVENTION

1. Field of the Invention

This invention relates an improved gaitor for cross-country skiing, mountaineering, and similar applications. More particularly, it relates to such a gaitor incorporating improved features of construction, which result in better protection for the wearer against moisture penetration and cold.

2. Description of the Prior Art

It has long been conventional practice in cross-country skiing, winter mountaineering and similar outdoor situations to wear gaitors to protect the feet and lower legs against penetration of snow or other moisture. Such gaitors are typically made of fabric that is wrapped around the lower leg and boot or shoetop, and secured with releasable fasteners. Hooks on the bottom of such gaitors engage boot or shoelaces to hold such gaitors in place at their bottom. However, with such gaitor designs, significant snow or other moisture penetration occurs around the bottom of the gaitors.

More recently, gaitor designs have become available which incorporate a rubber gasket around the bottom of the gaitor which conforms closely to a boot or shoe to prevent snow or other moisture penetration. However, moisture penetration still occurs at the seam between the fabric upper gaitor and the rubber gasket in such designs. Such gaitors are commercially available from Berghaus, Newcastle upon Tyne, NE1 1PG, England. While such a gaitor design significantly reduces snow and other moisture penetration, a need still remains for further improvement in gaitor design, especially for particularly demanding outdoor applications.

SUMMARY OF THE INVENTION

Accordingly, it is an object of this invention to provide a gaitor having increased protection against moisture penetration to the feet of a wearer.

It is another object of the invention to provide such a gaitor with increased warmth for the feet of a wearer, without overheating the wearer's calf.

It is a further object of the invention to provide a gaitor having an improved construction which prevents tearing at a location subject to stressing.

It is another object of the invention to provide such a gaitor which is held more securely in place against a shoe of the wearer.

The attainment of these and related objects may be achieved through use of the novel gaitor design herein disclosed. The gaitor of this invention includes an upper fabric portion configured to be wrapped around a leg of a wearer. The upper fabric portion includes a releasable means for fastening the fabric portion around the leg. The upper fabric portion has a lower edge. A flexible, water-impervious gasket configured to conform closely to a shoe worn by the wearer has an upper rim. The gasket is fastened to the fabric portion by means of a seam around the lower edge of the fabric portion. The lower edge of the fabric portion is folded up to lie against the upper rim of the gasket. The seam fastens the folded up lower edge against the upper rim of the gasket.

With this form of construction, moisture flowing down the upper fabric portion of the gaitor does not penetrate between the upper fabric portion and the rubber gasket. A significant source of moisture penetration in prior art gaitor designs is therefore eliminated.

The attainment of the foregoing and related objects, advantages and features of the invention should be more readily apparent to those skilled in the art, after review of the following more-detailed description of the invention, taken together with the drawings, in which:

DETAILED DESCRIPTION OF THE INVENTION

Figure 1:
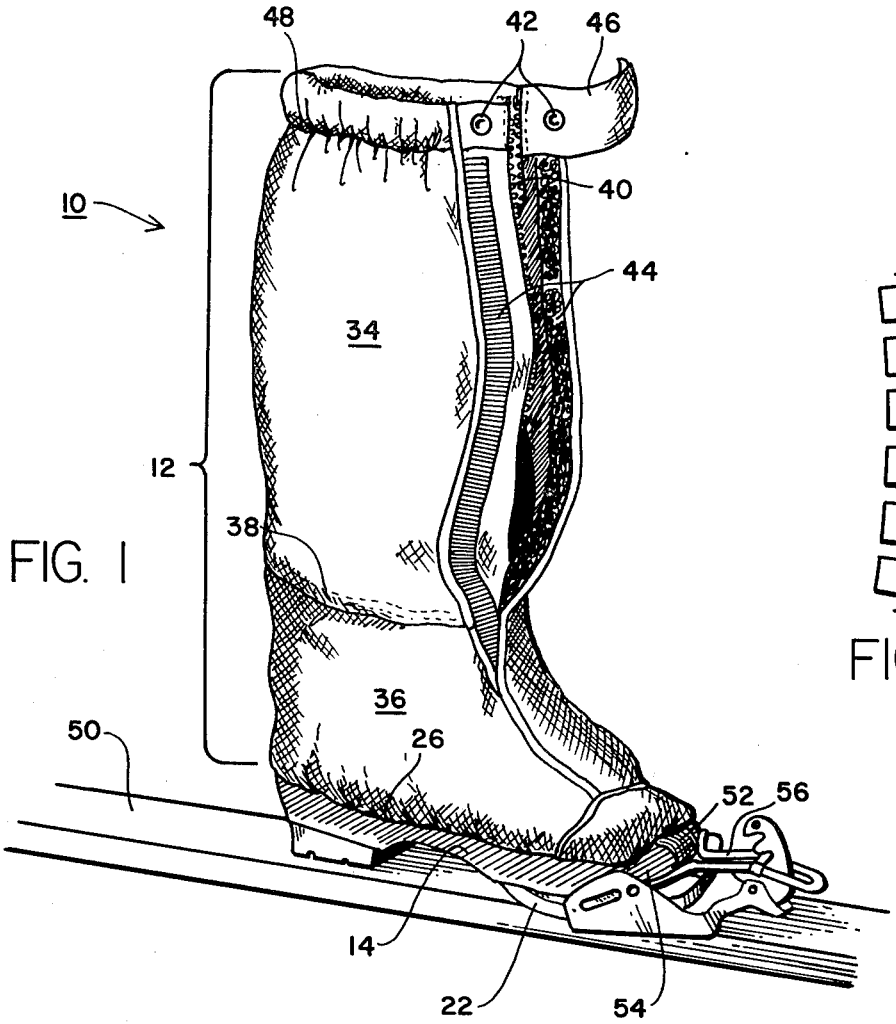
FIG. 1 is a perspective view of a gaitor in accordance with the invention, as worn by the user.
Figure 2:
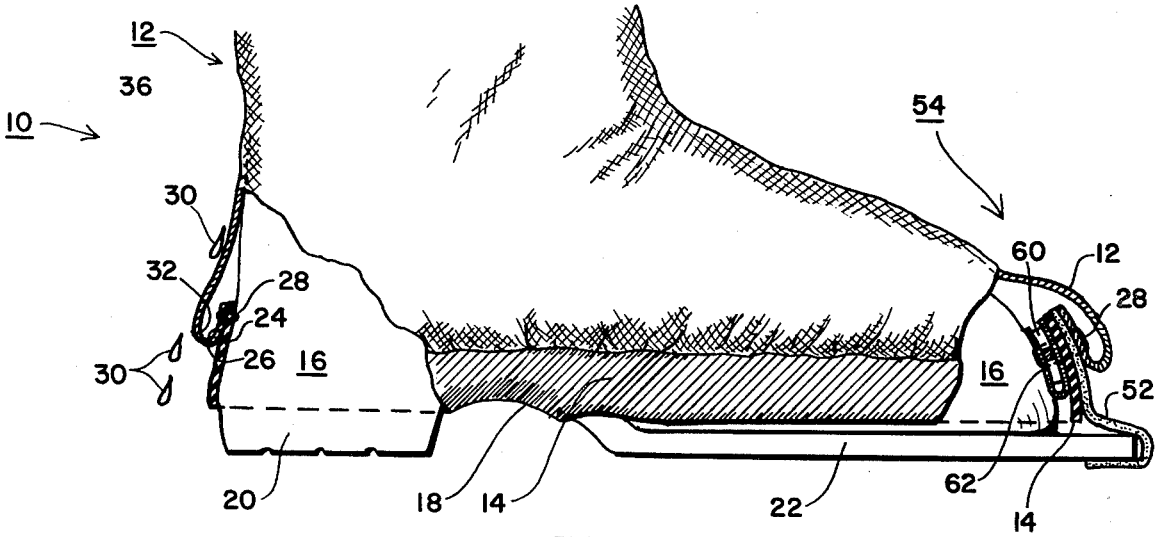
FIG. 2 a side view of the portion 2 of the gaitor shown in FIG. 1, with a partial cutaway to show interior detail.

Turning now to the drawings, more particularly to FIGS. 1 and 2, there is shown a gaitor 10 in accordance with the invention. The gaitor 10 includes an upper fabric portion 12 which surrounds the leg of a wearer, and a rubber gasket portion 14 which is configured as shown to conform closely to the wearer's shoe 16. The rubber gasket 14 extends across the sole of the shoe 16 at 18, in front of heel 20; however, the heel 20 and most of the sole 22 extend through apertures in the rubber gasket 14, in order to give the wearer traction. The rubber gasket 16 has an upper rim 24 (FIG. 2). The fabric portion 12 has a lower edge 26. The lower edge 26 is folded over to extend upward, as best shown in FIG. 2. The lower edge 26 of the fabric portion 12 and the upper rim 24 of the rubber gasket 14 are stitched together at 28 around the entire gaitor. As a result of this construction, water 30 flowing down the fabric portion 12 drips off the fold 32, rather than penetrating between the fabric portion 12 and the rubber gasket 14.

The gaitor of FIG. 1 incorporates additional highly desirable features. The fabric portion 12 of the gaitor 10 incorporates an upper half 34 and a lower half 36, with the upper half 34 being joined to the lower half 36 by a double seam 38, with the upper portion having an upturned edge similar to that shown in FIG. 2 for joining the lower portion 36 to the rubber gasket 14. The upper portion 34 is formed from a fabric treated to allow moisture to move outward from the wearer, but block moisture from passing through the fabric toward the wearer, such as a two-layer Gortex laminated Taslan nylon cloth. This fabric prevents penetration of moisture to the wearer's leg, while preventing the wearer's calf from becoming overheated during the substantial exertion of cross-country skiing or other mountaineering.

In contrast, the lower half 36 of the fabric portion 12 is formed from an insulated fabric, such as commercially available Thinsulate fabric, available from Minnesota Mining & Manufacturing Company, Minneapolis, Minn. Such an insulated fabric is used to provide increased protection for the wearer's foot against cold from snow and cold water encountered in use of the gaitor 10.

In order to allow the gaitor 10 to be easily put on and taken off, a zipper 40, extending down to the rubber gasket 14, is provided for opening and closing the fabric portion 12 of the gaitor 10. A snap fastener 42 is provided at the top of zipper 40, and opposing Velcro strips 44 are mounted along the length of zipper 40 to help seal the fabric portion 12 of the gaitor 10 against moisture penetration at the zipper 40. A tab 46 is provided for helping to open and close the snap fastener 42 when the user is wearing gloves. A drawstring 48 is provided at the top of fabric portion 12 to tighten the fabric portion 12 around a wearer's leg. With the zipper 40 and other fasteners open, a user may leave the gaitor 10 attached to shoe 16, yet insert and remove a foot easily to and from the shoe 16.

For use with a cross-country ski 50, a second tab 52 is sewn into the seam 28 joining the fabric portion 12 to rubber gasket 14 at the toe 54 of the gaitor 10. The tab 52 has a sufficient length to extend down the toe 54 and underneath the sole 22 when the shoe 16 is on the cross-country ski 50. Toe clip 56 of the cross-country ski 50 clamps the tab 52 against the toe 54. This clamping and the action of the end of tab 52 beneath sole 22 helps to maintain the gaitor 10 in proper position on the shoe 16.

Figure 3:
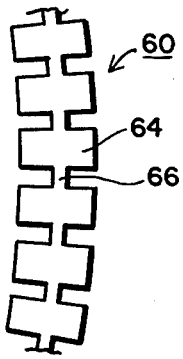
FIG. 3 is a plan view of a portion of the gaitor shown in FIGS. 1 and 2.

FIGS. 2 and 3 show details of the construction at the toe 54 of the gaitor 10. A structure tape 60 is positioned on the inside of the rubber gasket 14 opposite the fabric portion 12 at the seam 28 in toe 54. The second tab 52 is positioned between the rubber gasket 14 and the fabric portion 12. The structure tape 60 is enclosed in a folded over fabric strip 62. Seam 28 extends through the entire assembly. The structure tape 60 is formed from a stiff nylon sheet die cut into a strip having alternating relatively wide portions 64 and narrow portions 66. The structure tape 60 prevents the rubber gasket 14 from folding at the toe 54. The construction of the structure tape 60 provides substantial rigidity normal to its length but flexibility along its length to achieve this result. As a result, the stitches in seam 28 are prevented from tearing the rubber gasket 14 at the toe 54. Such folding is not a problem at other areas of the seam 28.

It should now be readily apparent to those skilled in the art that a novel gaitor capable of achieving the stated objects of the invention has been provided. The construction of the gaitor provides increased protection against moisture penetration to the feet of a wearer over prior art gaitor designs. The gaitor also provides increased warmth for the feet of a wearer, without overheating the wearer's calf. The gaitor is held securely in place against a shoe of the wearer.

It should further be apparent to those skilled in the art that various changes in form and details of the invention as shown and described may be made. It is intended that such changes be included within the spirit and scope of the claims appended hereto.

What is claimed is:

1. A gaitor, comprising an upper fabric portion configured to be wrapped around a leg of a wearer and including a releasable means for fastening the fabric portion around the leg, said fabric portion having a lower edge, and a flexible, water impervious gasket configured to conform closely to a shoe worn by the wearer and having an upper rim, said gasket being fastened to said fabric portion by means of a seam around the lower edge of said fabric portion, the lower edge of said fabric portion being folded up to lie against the upper rim of said gasket, and the seam fastening the folded up lower edge against the upper rim of said gasket, said upper fabric portion having an upper and a lower half, the upper half being formed from a fabric treated to allow moisture to move outward from the wearer but block moisture from passing through the fabric toward the wearer, and the lower half being formed from an insulating fabric.

2. The gaitor of claim 1 in which said gasket is rubber.

3. The gaitor of claim 1 additionally comprising a flexible tab fastened to said gaitor proximate to the lower edge of said fabric portion and having a sufficient length to extend over a toe of the shoe and beneath a sole of the shoe to be locked in position by a toe clamp of a ski to which the shoe is attached.

4. The gaitor of claim 1 additionally comprising a structural member flexible along its length and having substantial rigidity normal to its length and positioned at the seam joining said fabric portion to said gasket at a toe portion of said gasket and said fabric section.

5. The gaitor of claim 1 in which the folded up lower edge of said upper fabric portion lies against an outside surface of said gasket.

6. In a gaitor having an upper fabric portion joined by a seam to a flexible, water impervious gasket configured to conform closely to a shoe worn by a wearer, the improvement comprising a structural member flexible along its length and having substantial rigidity normal to its length, said structural member being positioned along the seam to prevent folding of said gasket at a toe portion of said gasket and said fabric portion, where folding is prone to occur.

7. The gaitor of claim 6 in which said structural member is a strip having alternating portions of a given width and a reduced width relative to the given width.

8. The gaitor of claim 7 in which said structural member is formed from nylon.

9. The gaitor of claim 6 in which a folded up lower edge of said upper fabric portion lies against an outside surface of said gasket at the seam.

* * * * *